US011363934B2

(12) United States Patent
Greenwood

(10) Patent No.: US 11,363,934 B2
(45) Date of Patent: Jun. 21, 2022

(54) ROTARY SEGMENTED FLOOR STRIPPING PAD

(71) Applicant: ACS Industries, Inc., Lincoln, RI (US)

(72) Inventor: George Greenwood, Tiverton, RI (US)

(73) Assignee: ACS Industries, Inc., Lincoln, RI (US)

( * ) Notice: Subject to any disclaimer, the term of this patent is extended or adjusted under 35 U.S.C. 154(b) by 108 days.

(21) Appl. No.: 15/901,201

(22) Filed: Feb. 21, 2018

(65) Prior Publication Data

US 2018/0235427 A1 Aug. 23, 2018

Related U.S. Application Data

(60) Provisional application No. 62/461,897, filed on Feb. 22, 2017.

(51) Int. Cl.
*A47L 13/16* (2006.01)
*A47L 11/40* (2006.01)
(Continued)

(52) U.S. Cl.
CPC ..... *A47L 13/16* (2013.01); *A47L 11/14* (2013.01); *A47L 11/1625* (2013.01); *A47L 11/4038* (2013.01); *A47L 13/10* (2013.01)

(58) Field of Classification Search
CPC .... A47L 11/14; A47L 11/162; A47L 11/1625; A47L 11/4038; A47L 11/16;
(Continued)

(56) References Cited

U.S. PATENT DOCUMENTS 760,080 A 5/1904 Racicat et al.
1,216,488 A 2/1917 Pfeiffer
(Continued)

FOREIGN PATENT DOCUMENTS

CA 2878004 A1 * 8/2015 ..... A47L 11/164
DE 102008025554 A1 12/2008
(Continued)

OTHER PUBLICATIONS

MyCleankLink NPL, published Aug. 2010 (Year: 2010).*
(Continued)

*Primary Examiner* — Tyrone V Hall, Jr.
*Assistant Examiner* — Makena S Markman
(74) *Attorney, Agent, or Firm* — Barlow, Josephs & Holmes, Ltd.; Stephen J. Holmes

(57) ABSTRACT

The present disclosure provides a segmented rotary floor stripping pad having a plurality of symmetrical, polygonal pad segments secured together in partially overlapping relation to form an annular pad. The segments are preferably formed from non-woven polyester fibers and are secured radially along the overlapping, adjacent side edges by hot melt glue, ultrasonic welding or by stitching. There is no backing pad, and since the segments are symmetrical, the pad is reversible so that both sides can be used. The plurality of pad segments are secured together in an overlapping manner such that each pad segment presents an angled leading cutting edge and each pair of adjacent pad segments forms a radial fluid channel. Depending on the degree of overlap and the thickness of the pad segment, the presentation angle of the cutting edge can be varied.

21 Claims, 3 Drawing Sheets

(51) Int. Cl.
*A47L 11/14* (2006.01)
*A47L 11/162* (2006.01)
*A47L 13/10* (2006.01)

(58) Field of Classification Search
CPC ..... A47L 11/164; A47L 11/20; A47L 11/283; A47L 13/16; A47L 13/10; B24B 7/18; B24B 7/186; B24B 23/02; B24D 13/045; B24D 13/16; B24D 11/02; B24D 13/14; B24D 13/18
USPC ..... 15/230.14, 230.15, 230.16; 451/353, 451/359, 527, 529
See application file for complete search history.

(56) References Cited

U.S. PATENT DOCUMENTS 2,024,691 A * 12/1935 Robert ..... B24D 13/045 15/230.1
2,027,425 A * 1/1936 Hall ..... B24D 13/16 15/230.16
2,033,253 A 3/1936 Pfohi
2,104,925 A 1/1938 Goodman
2,654,978 A * 10/1953 Delenk ..... B24D 13/045 15/230.14
2,907,147 A * 10/1959 Hall ..... B24D 13/16 451/527
3,110,139 A * 11/1963 Miller ..... B24D 13/045 15/230.14
3,176,438 A 4/1965 Churchill
3,346,903 A * 10/1967 Darak, Jr. ..... B24D 13/02 15/230.1
3,703,739 A * 11/1972 Young ..... A47L 11/164 15/230.17
4,607,412 A 8/1986 Ashworth
4,679,360 A 7/1987 Eisenblatter
4,718,204 A 1/1988 Eisenblatter
4,724,567 A * 2/1988 Rones ..... A47L 11/164 15/230.14
5,201,149 A * 4/1993 Eisenblatter ..... B24D 9/085 15/230.17
5,247,767 A 9/1993 Hadgis
5,438,728 A 8/1995 Kubes et al.
5,626,512 A * 5/1997 Palaikis ..... D04H 1/60 451/536
5,752,876 A 5/1998 Hettes
5,951,389 A * 9/1999 Hettes ..... B24B 45/006 451/508
5,996,167 A * 12/1999 Close ..... B24D 3/28 15/230.12
6,066,034 A 5/2000 Hettes et al.
6,110,027 A * 8/2000 Muller ..... B24B 55/052 451/342
6,299,520 B1 * 10/2001 Cheyne, III ..... A01N 25/34 451/532
6,428,406 B1 8/2002 Katsuyama et al.
6,582,289 B1 6/2003 Eisenberg
6,863,596 B2 * 3/2005 Fritz ..... B24D 13/20 451/342
6,869,339 B2 3/2005 Pham
7,004,829 B2 2/2006 Keuler
7,481,699 B2 1/2009 Schweitzer
7,727,056 B2 * 6/2010 Gilles ..... B24D 13/16 451/465
7,828,633 B1 11/2010 Gilles
9,415,483 B2 8/2016 Krause et al.
2009/0088054 A1 4/2009 Gilles
2013/0273822 A1 10/2013 Daday et al.
2014/0080392 A1 * 3/2014 Eisenblaetter ..... B24D 11/00 451/490

FOREIGN PATENT DOCUMENTS

DE 202010008898 U1 2/2011
GB 788149 A * 12/1957 ..... A47L 11/4038
JP 09173262 A 7/1997
JP 2004009018 A 1/2004
JP 2005319450 A 11/2005
JP 2006034604 A 2/2006
JP 2015175177 A 10/2015
KR 1020060111607 A 10/2006
WO 0038883 A1 7/2000
WO 2015119826 A1 8/2015

OTHER PUBLICATIONS

3M Floor Pads—"Durable solutions for a sustainable future" 3M Science-Applied to Life—Cleaning and Workplace Safety, Jul. 2017.
3M High Productivity Pad 7300—Technical Data Sheet 7300, Oct. 2016.

* cited by examiner

ROTARY SEGMENTED FLOOR STRIPPING PAD

BACKGROUND OF THE INVENTION

(1) Field of the Invention

The instant invention relates to rotary floor pads used in conjunction with the cleaning and stripping of wax floors.

(2) Description of Related Art

Floor pads for stripping and cleaning wax floors are well known in the art. The typical prior art floor pad comprises a planar, annular disk cut from a monolithic sheet of a porous abrasive material. The prior art pads are acceptable for certain applications, but for the particular purpose of stripping floors, several drawbacks have been identified. The flat monolithic surface of the prior art pads does not provide an aggressive stripping edge and therefore the process of stripping can take longer than desired. Floors in commercial and educational buildings are typically stripped and re-waxed overnight, and it is highly desirable to complete the job as quickly as possible. Further, the stripping process involves the use of a stripping fluid which helps dissolve built up wax. In the process of stripping, the fluid and stripped wax material quickly build up and clog the porous material of the pad and degrade the effectiveness within a short period of time. In this regard, the pads must be flipped over or changed often to avoid the wax build up. The quick build up and clogging increases the number of pads required for the job, adds time to the job for repeated pad changes, and thus makes the job more expensive.

SUMMARY OF THE INVENTION

The present disclosure provides a segmented rotary floor stripping pad having a plurality of symmetrical, preferably polygonal, pad segments secured together in partially overlapping relation to form an annular pad. The segments are preferably formed from open-textured, non-woven polymer fibers and they are secured radially along the overlapping, adjacent side edges by hot melt glue, ultrasonic welding or by stitching. Abrasive particles may be dispersed throughout the pad material and are bonded to the material with a durable resin system. There is no backing pad, and since the segments are symmetrical, the pad is reversible so that both sides can be used. The plurality of pad segments are secured together in an overlapping manner such that each pad segment presents an angled, leading cutting edge in the direction of rotation, and further such that each pair of adjacent pad segments forms a radial channel for air and fluid flow. Depending on the degree of overlap, the width of the pad segment and the thickness of the pad segment, the presentation angle of the cutting edge can be varied.

In use, as the pad rotates, the leading cutting edges bite into the wax and aggressively strips wax from the floor. The rotary motion of the pad also centrifugally pushes stripping fluid and stripped wax material radially outward along the channels to keep the underside of the pad cleaner and free of wax build up for a longer time.

Some embodiments may comprise varying numbers of pad segments. Preferably, each pad comprises 24 symmetrically identical segments. Other embodiments may include toothed edges or scalloped edges.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
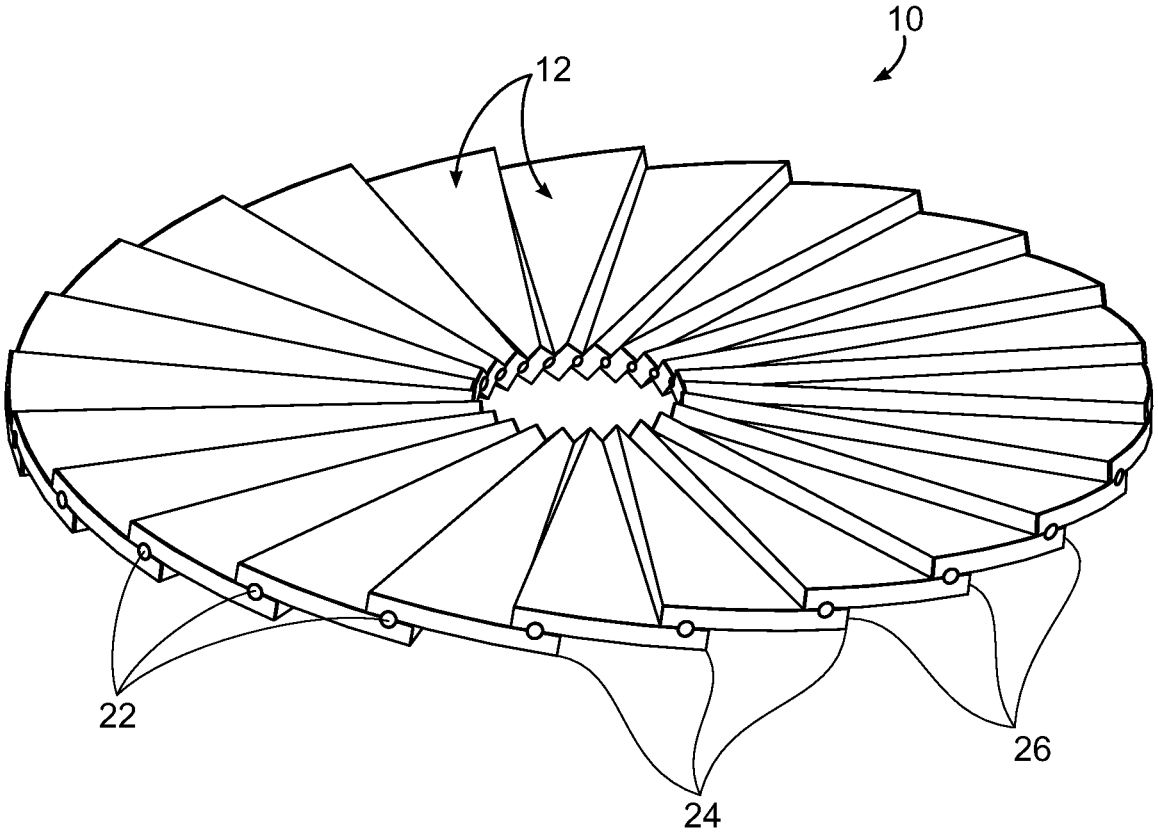
FIG. 1 is a perspective view of an exemplary embodiment of the present segmented floor stripping pad.

Referring now to the drawings, an exemplary embodiment of the present floor stripping pad is generally indicated at 10 in FIGS. 1-6. As will be explained further herein, the floor stripping pad 10 is used in conjunction with a rotary floor cleaning machine (not shown) which is well known in the art. The exemplary pad 10 is placed beneath the machine and is held in place by friction. In other exemplary embodiments, the pad can be held in place by the use of a center screw on the rotary floor machine which keeps the pad concentric. In use, the pad 10 rotates beneath the machine in a counterclockwise direction.

The exemplary embodiment illustrates a segmented rotary floor stripping pad 10 comprising a plurality of symmetrical, polygonal pad segments 12 that are secured together in partially overlapping relation to form an annular shaped pad generally of the same size and configuration as a conventional circular or annular floor pad.

Figure 6:
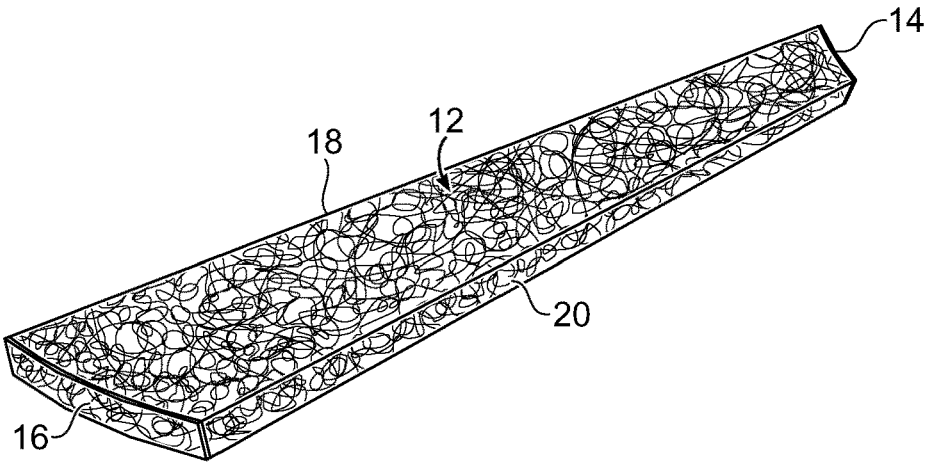
FIG. 6 is a perspective view thereof.

The pad segments 12 are preferably formed from an open-textured, non-woven polymer fiber material such as polyamide, polyester or nylon fiber material. Other polymer fiber materials, are also contemplated. In some embodiments, the non-woven fiber material may also include natural fibers, such as walnut fibers or coconut fibers. In still other embodiments, the non-woven material may include mineral or resin abrasive particles which are uniformly distributed throughout, and securely bonded to the non-woven fiber material with a phenolic or latex resin coating. The non-woven fibrous nature of the material is best seen in FIG. 6.

The prior art pads are stamped out of a pre-formed planar sheet of such a material. However, the stamping process leaves a substantial amount of edge waste which must be recycled or discarded. The present pad segments 12 are symmetrical wedges which can be stamped, for example, from the same sheet of material with very little waste.

Figure 4:
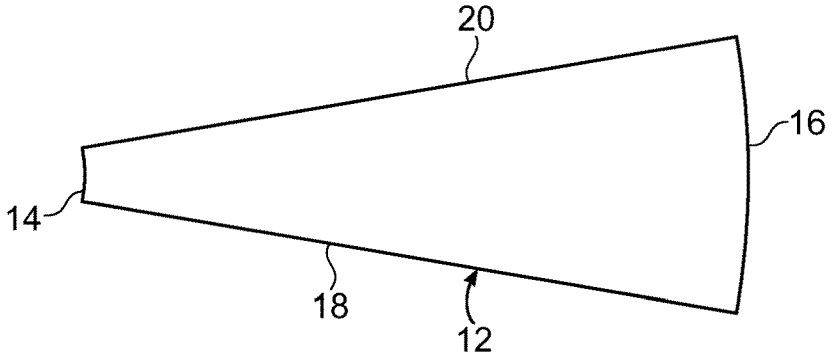
FIG. 4 is a top view of a single pad segment.
Figure 5:
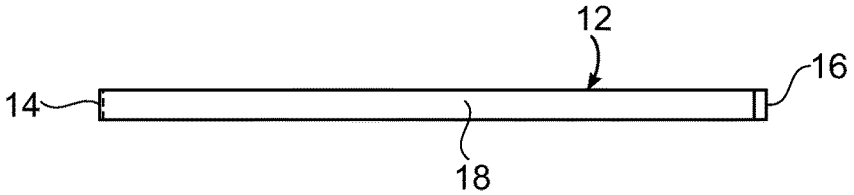
FIG. 5 is a side view thereof.

As seen in FIG. 4, each pad segment 12 is polygonal in shape having an inner arcuate circumferential edge 14, an outer arcuate circumferential edge 16 and opposing side edges 18, 20. The arcuate pad segment 12 preferably measures about 20° of arc. However, other embodiments may have larger or smaller dimensions.

Figure 3:
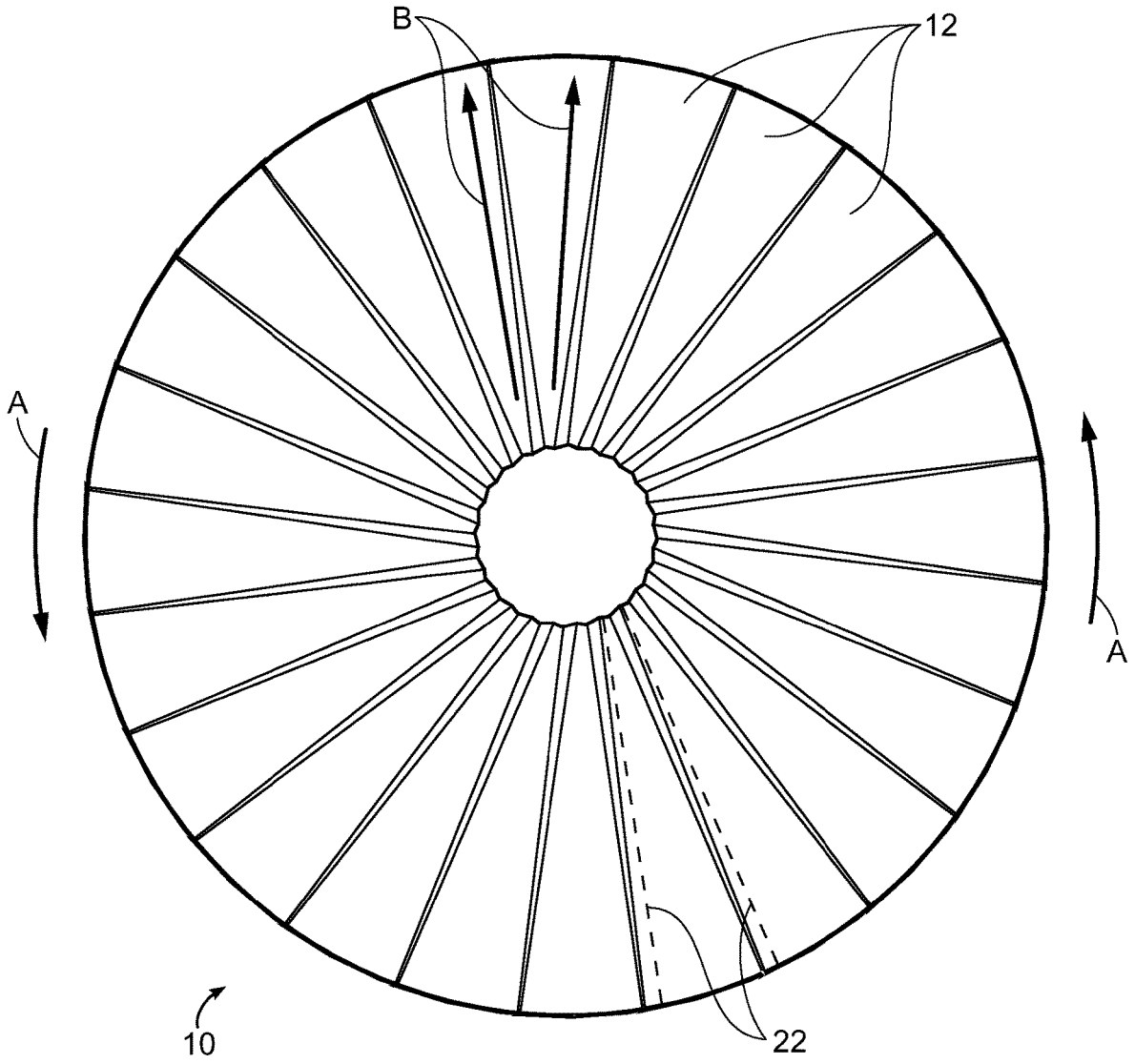
FIG. 3 is a top view thereof.

Turning back to FIG. 1, it can be seen that twenty-four (24) pad segments 12 are secured radially along their overlapping, adjacent side edges to form the annular shape of the pad. In the exemplary embodiment, the pad segments are preferably secured by radially extending beads of hot melt glue 22 which extend along substantially the entire length of the side edges (dotted line in FIG. 3). In other embodiments, the segments may be ultrasonically welded or stitched along the same edges. It is important to note that there is no backing pad, and since the segments 12 are symmetrical, the pad 12 is reversible so that both sides can be used. The plan view of the top surface shown in FIG. 3 is identical to a plan view of the bottom surface (not shown).

Figure 2:
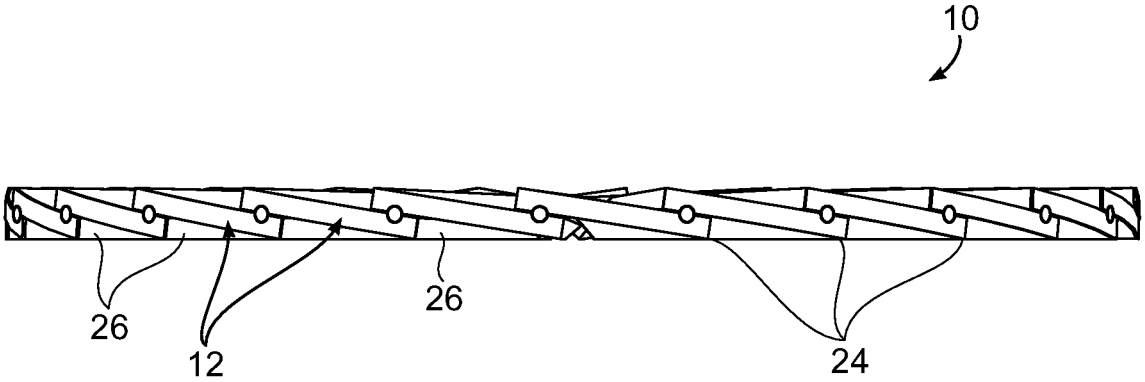
FIG. 2 is a side view thereof.

Turing back to FIGS. 1 and 2, the plurality of pad segments 12 are secured together in an overlapping manner such that each pad segment 12 presents an angled leading cutting edge 24 and each pair of adjacent pad segments forms a radial fluid channel 26. Depending on the degree of overlap, the width of the pad segment 12 and the thickness of the pad segment 12, the presentation angle of the leading edge 24 can be varied.

In use, as the pad rotates (See arrows A in FIG. 3), the leading cutting edges 24 bite into the wax and aggressively strip wax from the floor. The rotary motion of the pad 12 also centrifugally pushes stripping fluid and excess wax material radially outward (See arrows B) along the fluid channels 26 to keep the underside of the pad clean and free of wax build up.

Some embodiments may comprise varying numbers of pad segments. Preferably, each pad comprises 24 symmetrically identical segments. The dimension, shape and configuration of the segments may be modified to suit the application at hand.

Other embodiments may include toothed leading edges or scalloped edges. Still further embodiments may include non-linear leading edges for different stripping action.

It can therefore be seen that the exemplary embodiments provide a novel and inventive floor stripping pad, which more quickly strips wax buildup from floors and has a longer useful life.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A floor stripping pad for stripping wax from a floor comprising:

a plurality of planar, polygonal, symmetrical, pad segments, each pad segment having a thickness "T", each pad segment comprising an open textured, non-woven polymer fiber material, said plurality of pad segments being secured together in partially overlapping circumferential relation to form an annular segmented pad having an upper stripping surface configured to engage a floor in its entirety and also having an opposed lower stripping surface configured to engage said floor in its entirety, each pair of adjacent pad segments having overlapping side edge portions which are secured together, between said each pair of adjacent pad segments, along an attachment line extending in a radial direction between a radially inner most edge of each pair of adjacent pad segments to a radially outer most edge of each pair of adjacent pad segments, said radially inner most edges being exposed, said overlapping side edge portions and said thickness "T" of each of said pad segments cooperating such that each pad segment is disposed at an angle to said floor and presents a radially extending, angled leading cutting edge forward of said attachment line for engagement with said floor in a direction of rotation on each of said upper and lower stripping surfaces, and further such that said annular segmented pad is reversible with said upper and lower stripping surfaces being useful in the same direction of rotation, said angled leading cutting edges of each pair of adjacent pad segments further forming a radially extending fluid flow channel therebetween in which stripping fluid and dissolved stripped wax is centrifugally pushed radially outward during rotation about an axis on said floor.

2. The floor stripping pad of claim 1 comprising 24 pad segments.

3. The floor stripping pad of claim 1, wherein said pad segments are secured by a method selected from gluing, ultrasonic welding, and stitching.

4. The floor stripping pad of claim 2, wherein said pad segments are secured by a method selected from gluing, ultrasonic welding, and stitching.

5. The floor stripping pad of claim 1, wherein said non-woven polymer fiber material is selected from the group consisting of polyamide, polyester and nylon.

6. The floor stripping pad of claim 3, wherein said non-woven polymer fiber material is selected from the group consisting of polyamide, polyester and nylon.

7. The floor stripping pad of claim 4, wherein said non-woven polymer fiber material is selected from the group consisting of polyamide, polyester and nylon.

8. The floor stripping pad of claim 1 further comprising abrasive particles distributed throughout and bonded to said non-woven polymer fiber material.

9. The floor stripping pad of claim 2 further comprising abrasive particles distributed throughout and bonded to said non-woven polymer fiber material.

10. The floor stripping pad of claim 3 further comprising abrasive particles distributed throughout and bonded to said non-woven polymer fiber material.

11. The floor stripping pad of claim 1 further comprising natural fibers distributed throughout said non-woven polymer fiber material.

12. The floor stripping pad of claim 3 further comprising natural fibers distributed throughout said non-woven polymer fiber material.

13. The floor stripping pad of claim 8 further comprising natural fibers distributed throughout said non-woven polymer fiber material.

14. A floor stripping pad for stripping wax from a floor comprising:

a plurality of planar, polygonal, symmetrical, pad segments, each pad segment having a thickness "T", each pad segment formed from an open textured, non-woven polymer fiber material, said plurality of pad segments being secured together in partially overlapping circumferential relation to form an annular segmented pad, having an upper stripping surface configured to engage a floor over its entirety and also having an opposed lower stripping surface configured to engage said floor over its entirety, each pair of adjacent pad segments having overlapping side edge portions which are secured along said overlapping side edge portions along an attachment line extending radially, said overlapping side edge portions and said thickness "T" of each of said pad segment portions cooperating such that each pad segment is disposed at an angle to said floor and presents a radially extending, angled leading cutting edge forward of said attachment line for engagement with said floor in a direction of rotation on each of said upper and lower stripping surfaces, said angled leading cutting edges of each pair of adjacent pad segments forming a radially extending fluid flow channel therebetween in which stripping fluid and dissolved stripped wax is centrifugally pushed radially outward during rotation on a floor, and said segmented pad being reversible with said upper and lower stripping surfaces being useful in the same direction of rotation.

15. The floor stripping pad of claim 14 comprising 24 pad segments.

16. The floor stripping pad of claim 14, wherein said pad segments are secured by a method selected from gluing, ultrasonic welding, and stitching.

17. The floor stripping pad of claim 15, wherein said pad segments are secured by a method selected from gluing, ultrasonic welding, and stitching.

18. The floor stripping pad of claim 14, wherein said non-woven polymer fiber material is selected from the group consisting of polyamide, polyester and nylon.

19. The floor stripping pad of claim 17, wherein said non-woven polymer fiber material is selected from the group consisting of polyamide, polyester and nylon.

20. The floor stripping pad of claim 17, wherein said non-woven polymer fiber material is selected from the group consisting of polyamide, polyester and nylon.

21. The floor stripping pad of claim 14 further comprising abrasive particles distributed throughout and bonded to said non-woven fiber material.

* * * * *